United States Patent [19]

Gourdon et al.

[11] 4,439,905

[45] Apr. 3, 1984

[54] INSTALLATION FOR REPLACING A CONTAMINATED FLUID CIRCUIT AND PROCESS FOR REPLACING THIS MEMBER

[75] Inventors: Pierre Gourdon, Paris; René Goutard, Verriers le Buisson; Pierre Piry, Briis sous Forges, all of France

[73] Assignee: Commissariat a l'Energie Atomique, France

[21] Appl. No.: 282,602

[22] Filed: Jul. 13, 1981

[30] Foreign Application Priority Data

Jul. 15, 1980 [FR] France ..... 80 15606

[51] Int. Cl.[3] ..... B22D 19/10

[52] U.S. Cl. ..... 29/402.04; 29/402.08; 29/723; 29/426.3; 417/360; 376/262; 376/212; 212/213

[58] Field of Search ..... 29/426.3, 723, 402.08, 29/DIG. 400 N, 402.04; 414/723; 212/213, 218, 220, 221; 376/260, 262, 272; 417/360

[56] References Cited

U.S. PATENT DOCUMENTS

| | | | |
|---|---|---|---|
| 3,143,971 | 8/1964 | Green | 417/360 |
| 3,271,262 | 9/1966 | Hutchinson et al. | 376/262 |
| 3,558,012 | 1/1971 | Weis | 417/360 |
| 4,069,923 | 1/1978 | Blumenau et al. | 376/260 |
| 4,158,599 | 6/1979 | Andrews et al. | 376/262 |

OTHER PUBLICATIONS

"Fuel Handling System and Fuel Description", by W. R. Gee, Jr. et al., 1973, Nov., pp. 878 and 879.

*Primary Examiner*—Francis S. Husar
*Assistant Examiner*—David B. Jones

[57] ABSTRACT

The present invention relates to an installation for replacing a member in a contaminated fluid circuit. It also relates to a process for replacing this member.

Installations for treating contaminated fluids, particularly radioactive fluids, comprise pipe systems in which the contaminated fluid flows. These systems or circuits have transfer, distribution, purification and cleaning members and the like, such as pumps, valves, filters, etc. These members are subject to wear, particularly when they have moving parts, and/or dirt or pollutants. It is therefore necessary to replace them by new members or overhaul them at intervals of varying length. Besides such replacements due to wear or pollution, it may be necessary to replace one member by another having different characteristics, e.g. one pump by another pump having different operating principles and/or flow rates.

9 Claims, 5 Drawing Figures

Figure 1:
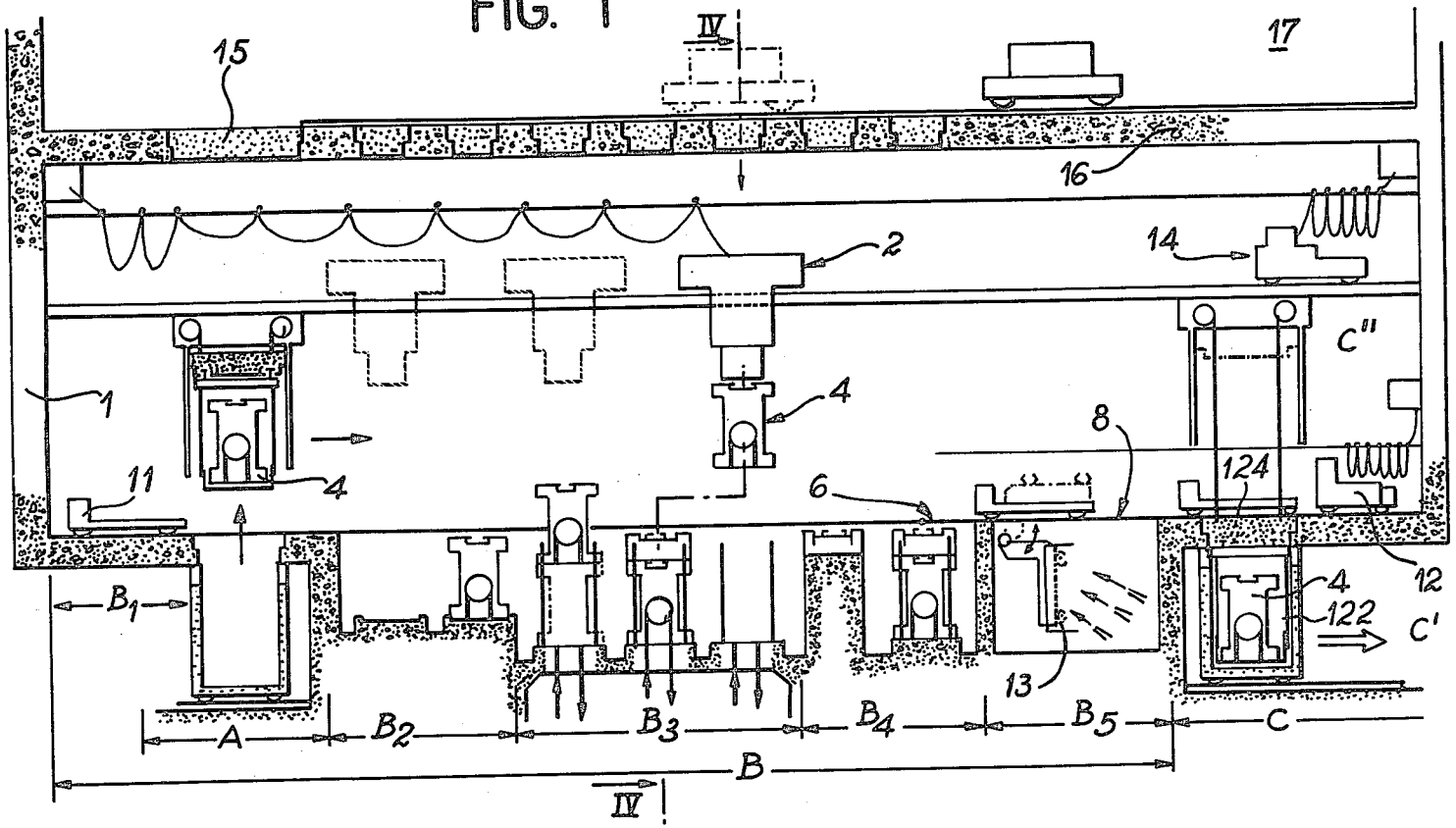

42
40
24
18
26
19
22
38
28
20
36
32
32
28
26

INSTALLATION FOR REPLACING A CONTAMINATED FLUID CIRCUIT AND PROCESS FOR REPLACING THIS MEMBER

The present invention relates to an installation for replacing a member in a contaminated fluid circuit. It also relates to a process for replacing this member.

Installations for treating contaminated fluids, particularly radioactive fluids, comprise pipe systems in which the contaminated fluid flows. These systems or circuits have transfer, distribution, purification and cleaning members and the like, such as pumps, valves, filters, etc. These members are subject to wear, particularly when they have moving parts, and/or dirt or pollutants. It is therefore necessary to replace them by new members or overhaul them at intervals of varying length. Besides such replacements due to wear or pollution, it may be necessary to replace one member by another having different characteristics, e.g. one pump by another pump having different operating principles and/or flow rates.

Hitherto the members to be replaced in contaminated fluid circuits have been installed in the circuits in a conventional manner, e.g. by connecting to pipes by screwed or bolted flanges. In the case of replacement assembly and disassembly take place under a protective casket using remote handling devices which, in the case of disassembly, loosen the bolts in the flanges and release the latter and, in the case of assembly of new parts, perform the opposite operations. However, this process is not satisfactory because it does not sufficiently reliably eliminate the risks of the spread of contamination, particularly due to the fact that in numerous cases it is difficult after disassembly operations and prior to fitting the new member to strictly isolate the remaining parts of the circuit from the environment. In addition, this known process has the disadvantage of requiring very long periods for carrying it out during which the installation cannot be used.

The invention relates to an installation making it possible to carry out the aforementioned replacement operations without it being necessary from the outset to work under a casket, the latter only being necessary after disassembly for the purpose of transferring the dismantled member to a repair or treatment workship. The operations involving the disassembly of the member to be replaced and the assembly of the replacement member take place in a very short time which does not significantly impair the production of the installation, whilst there is also no risk of contamination spread.

The invention applies more particularly to installations for treating radioactive fluids, but also applies outside this special field to any installation treating fluids liable to spread contamination of any type.

More specifically the present invention relates to an installation for replacing a member in a contaminated fluid circuit, characterized in that it comprises a tight container which internally has a base, whose supports are supported on a framework; an assembly, called a module which can be introduced into the tight container, said assembly being constituted by a horizontal base to which is fixed the member to be replaced, a ceiling or top which is tightly adapted to the walls of the container and a gripping head making it possible to lift the module by means of a travelling crane; means for centering the module relative to the tight container; means for tightly connecting the member to the contaminated fluid circuit when the module is placed in said container; and means for tightly driving the member fixed to the module.

Preferably the means for centering the module relative to the tight container are constituted by vertical columns integral with the base of the container and by tubular spacers integral with the module, each column comprising a lower centering part, an intermediate part with a smaller diameter, an upper centering part and a truncated cylindrical head connected to the upper centering part by a smaller diameter collar.

Preferably the means for tightly connecting the member to the contaminated fluid circuit are constituted by vertical ducts traversing the far end and base of the tight container, whose ends face the feed and discharge pipes of the member; joints placed between the ducts and the feed and discharge pipes; and means for flanging or clamping the module to the tight container so as to tightly secure the joints and thus bring about the sought sealing.

A particularly advantageous feature of the invention is constituted by the fact that the means for flanging or clamping the module to the tight container can be manipulated by means of a travelling crane. These flanging means are constituted by: a frame having in its upper part a gripping head identical to that of the module on which are mounted lateral yokes integral with vertical spindles, whose number is the same as that of the columns, said yokes being arranged so as to face the latter, the vertical spindles sliding in the frame and being moved upwards by a stack of elastic washers, the end thereof projecting above the frame, said yokes having oblong holes, whereof one end permits the passage of the truncated cylindrical heads of the columns, whilst the other narrower end only permits the passage of collars.

Thus, a circuit member can be dismantled very rapidly and replaced. It is then possible to install each of the members forming a fluid circuit on a module constructed according to the invention and to place this module in a tight container, all the said containers being enclosed within a tight enclosure for confining the contaminated fluid. This container comprises: means for introducing the modules in a good state into the enclosure; a travelling crane able to move over the entire length of the enclosure and permitting the vertical and horizontal handling of the module and frame; a rinsing or washing station for used modules; a tank on which can be placed the modules located on a trolley and able to move along rails installed over the entire length of the enclosure; means for rinsing or washing the said tank; and means for removing the unused modules from the enclosure.

The invention also relates to a process making it possible to disassemble a member of a contaminated fluid circuit. This process comprises the following stages: the installation is stopped and the member is uncoupled from its drive; the gripping device of the travelling crane is engaged with the gripping device of the frame associated with the module containing the member to be replaced, the jack is pressurized and the flanging or clamping device is set down; with the travelling crane the module containing the member to be replaced is raised and using the trolley the tank is placed beneath the module; with the travelling crane the module containing the member to be replaced is deposited in the tank and is transferred with the trolley to area B4; with the travelling crane a satisfactory or new module stored in area B2 is raised; with the travelling crane the module in a satisfactory or new state is transferred into the tight container which contained the member to be replaced, using the travelling crane the flanging device is engaged on the satisfactory or new module and then the pressure is removed in the jack in order to carry out flanging; and the new or satisfactory member is then coupled to its drive and the installation is started up again.

Other features and advantages of the invention can be gathered from the following description given in an illustrative and non-limitative manner and with reference to the attached drawings, wherein show:

FIG. 1 an installation for replacing a member of a contaminated fluid circuit constructed according to the invention.

Figure 2:
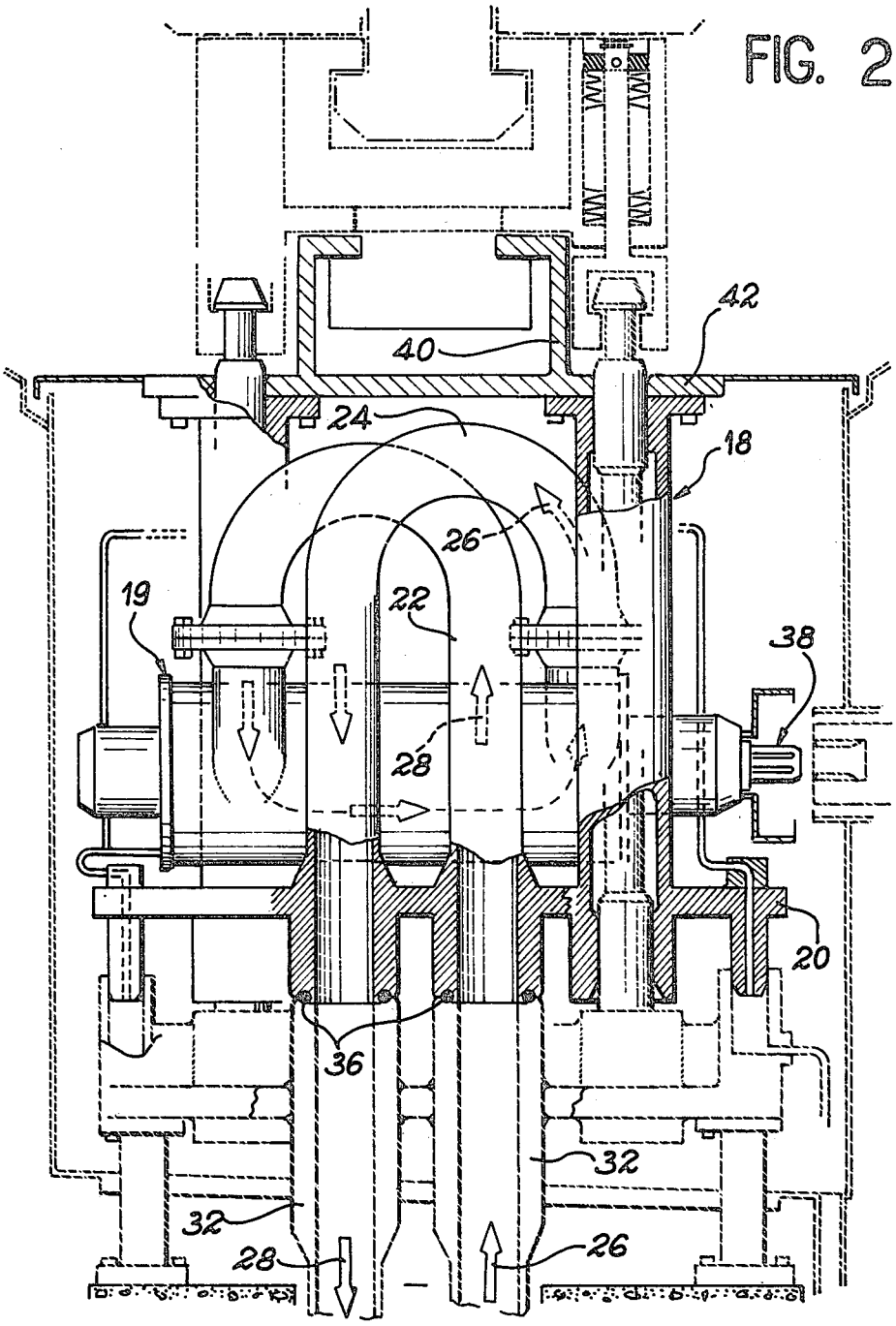

FIG. 2 a sectional view of a module according to the invention.

Figure 3:
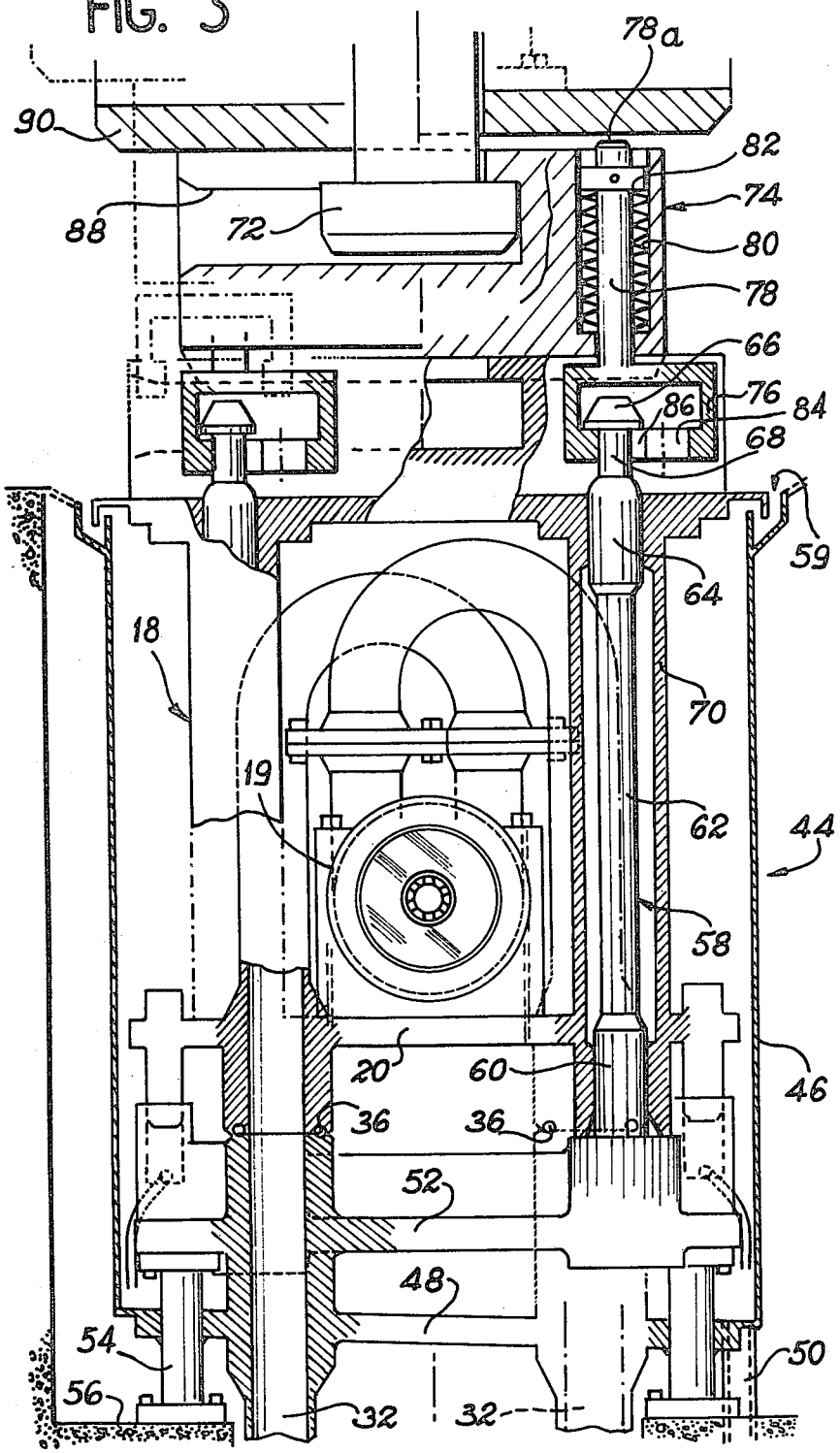

FIG. 3 a sectional view of a tight container containing the module shown in FIG. 2.

Figure 4:
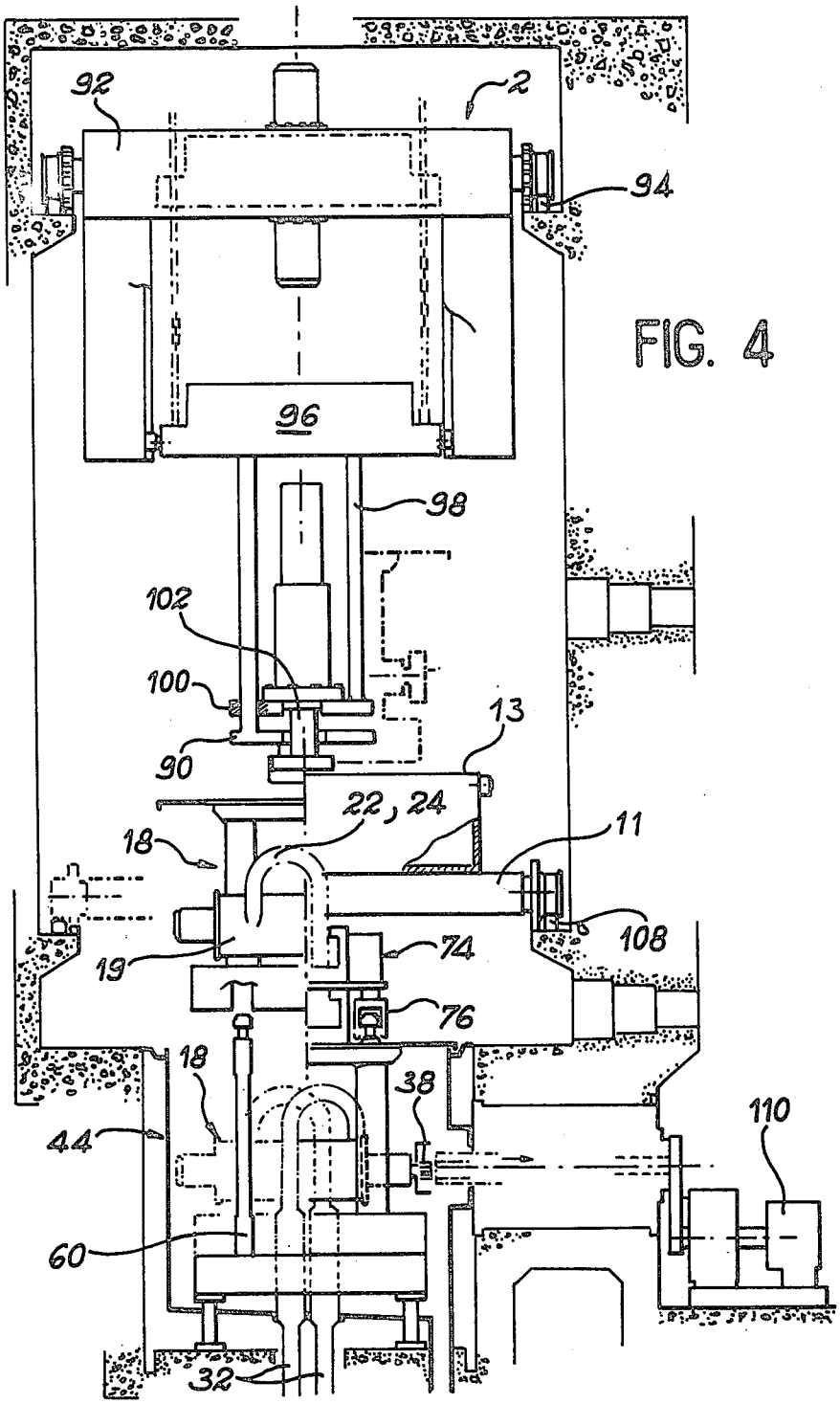

FIG. 4 a cross-sectional view along line IV—IV of the installation of FIG. 1.

Figure 5:
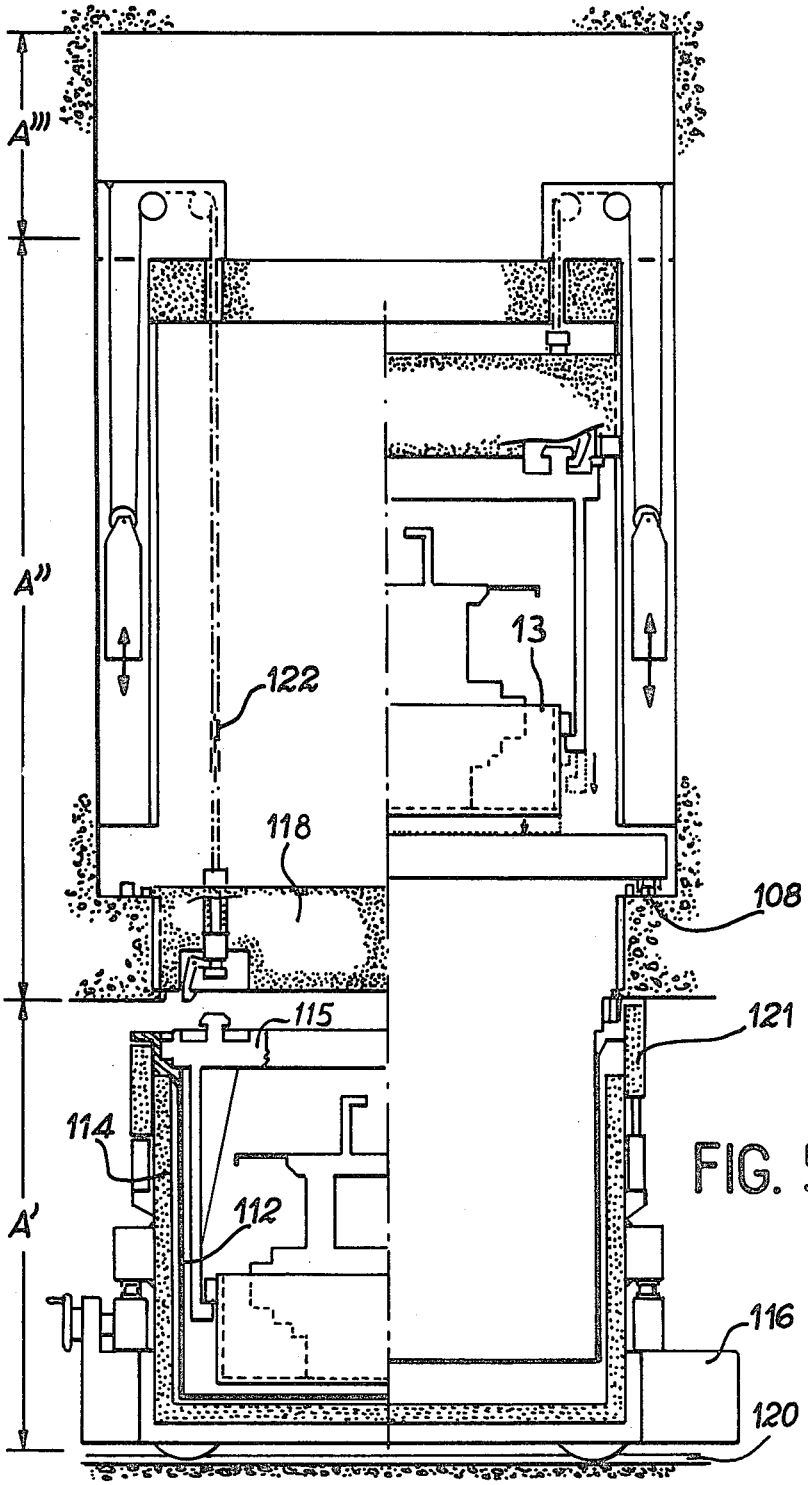

FIG. 5 a sectional view of the area for introducing modules into the enclosure.

FIG. 1 is a longitudinal sectional view of the installation for replacing the member of a contaminated fluid circuit constructed according to the invention. Each member of this circuit, such as a pump, valve, filter, etc. belongs to an assembly, referred to hereinafter as "the module". According to the invention these modules are designed in such a way that a defective module can be rapidly disassembled in order to be replaced by a new or satisfactory module. To this end the connections to the contaminated fluid circuit of the modules, as well as the drives for the members mounted on said modules are identical. It is therefore possible to easily replace a defective module by a satisfactory or new module on which is mounted an identical component or even a component of a different type. The structure of such modules will be explained in greater detail with reference to FIG. 2.

Moreover the system of modules constituting the contaminated fluid circuit is located within a tight enclosure 1.

From left to right in the drawing, i.e. upstream to downstream in the installation are successively provided a zone A for introducing the modules into the enclosure, an active zone B successively comprising a zone B1 for storing the tank trolley, a zone B2 for storing the modules in a new or satisfactory state, a zone B3 for the modules in service, a zone B4 for rinsing or washing the modules, a zone B5 for rinsing or washing the tank and finally a zone C for discharging the modules from the enclosure.

The tight enclosure 1 comprises means for introducing the modules in a new or satisfactory state, a travelling crane 2 which can move over the entire length of the enclosure and makes it possible to vertically and horizontally manipulate module 4. There is a rinsing or washing station 6 for the used modules, as well as a rinsing or washing station 8 for tank 13 within which the said modules are moved within the enclosure. Finally enclosure 1 has means for removing the modules which are not in use from the enclosure.

Thus, an installation is obtained in which the contaminated fluid is confined. Only modules and tanks which have been previously rinsed are removed from the enclosure.

Towards the downstream end the installation also comprises storage locations for standby trolleys, namely standby trolley 12 for the tank trolley and standby trolley 14 for the travelling crane. Above the ceiling or top 16 of the enclosure there is a service zone 17 equipped with a winch by means of which if an accident occurs to the devices positioned below ceiling 16 work can be carried out through openings provided with plugs 15. To the side of the assembly there is a machine room containing the drive means for the pumps, as well as the control means for the various devices used according to the invention.

FIG. 2 shows a module constructed according to the invention, designated by reference numeral 18 and comprising a horizontal base 20 to which is fixed that member 19 to be replaced. In the represented embodiment member 19 is a pump. However, this member could also be some other member such as a valve, filter, etc.

Pump 19 is connected to the contaminated fluid circuit by a feed pipe 22 and by a discharge pipe 24. The fluid circulates in the direction of arrows 26, 28 in pipes 22, 24 which are connected to the fluid circuit ducts 32. Joints 36 provide the seal between pipes 22, 24 and ducts 32. According to the invention joints 36 are compressed by means of a flanging device, which will be described in greater detail with reference to FIG. 3.

The horizontally positioned pump shaft 38 can be driven by a variable-speed motor via a retractable coupling. A gripping head 40 integral with ceiling 42 makes it possible to manipulate module 18 by means of a travelling crane. This gripping head has an inverted T-shaped opening.

FIG. 3 shows the tight container 44 and module 18 in a direction perpendicular to that of FIG. 1. Pump 19 is shown from the end.

Tight container 44 is constituted by a container 46 having an inclined end 48 and provided with an overflow 50 equipped with a leak detector. Tight container 44 is used for collecting accidental outflows of contaminated liquid coming from pump 19 and its connections or fittings.

The tight container has a fixed base 52 provided with supports 54 traversing end 48 of container 46 and transferring the weight of module 18 to a framework 56.

Ceiling 42 is a sealingly adapted to the walls of container 44. In the present embodiment the seal between ceiling 42 and container 44 is provided by means of a hydraulic joint 59.

As has been stated pump 19 can be replaced by a random member such as a filter or valve, provided that the member is identically fitted within container 44. In particular it is necessary for the diameter and location of the pipes by which member 19 is connected to the contaminated fluid circuit are identical between the individual members. It is necessary for the coupling of the member to be identically positioned. Thus, according to the invention means are provided for centering module 18 relative to tight container 44, when it is introduced into the latter. In the present embodiment these means are constituted by four vertical columns 58 integral with base 52 of the tight container. Columns 58 have a lower centering portion 60, an intermediate portion 62 with a smaller diameter, an upper centering portion 64 with an identical diameter to that of the lower portion and finally a truncated cylindrical head 66 connected to the upper centering portion 64 by a smaller diameter collar 68. Columns 58 cooperate with an identical number of tubular spacers 70 integral with the frame. Thus, when each of the columns 58 is introduced into the corresponding tubular spacer 70 module 18 is correctly centered relative to tight container 44 is such a way that the ends of pipes 22 and 24 face ducts 32 of the contaminated fluid circuit. In an identical manner the drive shaft of member 19 faces the retractable coupling.

This drawing also shows the flanging or clamping device on base 52 of the tight container, as well as the inverted T-shaped shoulder 72 of the travelling crane.

The flanging or clamping device comprises a frame 74 on which are mounted lateral yokes 76 integral with vertical spindles 78. Yokes 76 are provided in the same number as columns 58 and their spacing is identical to that of the latter. Spindles 78 slide in frame 74. They are moved upwards by means of a stack of elastic washers 80 of a stop ring 82 and immobilized on spingle 78. The length of spindle 78 is such that when yoke 76 is engaged with frame 74, its end **78*a* projects above the frame. In their lower portion yokes 76 have an elongated opening. This opening is constituted by a cylindrical part 84, whose diameter is sufficiently large to enable the truncated cylindrical head 66 of column 58 to pass through the latter, as well as a reduced diameter second part 86 so that only collar 68 can pass through the latter. Thus, when frame 74 is longitudinally displaced by means of travelling crane 2 heads 66 can be introduced into yokes 76**.

Frame 74 also has a gripping head 88 with an inverted T-shaped opening identical to gripping head 40 of the module in order to permit the manipulation thereof by means of a single shoulder 72. A back-plate 90 fixed to the travelling crane is shown above the flanging device. Back-plate 90 serves as a fixed abutment against which can engage frame 74. In the right-hand part of the drawing it is possible to see frame 74 when not engaged with back-plate 90. The left-hand part of the drawing shows frame 74 engaged with back-plate 90.

On a reduced scale compared with FIG. 3, FIG. 4 shows module 18 located in tight container 44, as well as travelling crane 2 permitting the lifting of said module. Travelling crane 2 comprises a frame 92 which is horizontally movable on rails 94. A frame 96 positioned below frame 92 can move vertically in translation relative to frame 92. It is moved by means of chains 94 driven by chain wheels. At the end of columns 98 frame 96 carries a supporting plate 100 to which is fixed a hydraulic jack 102. At the end of the piston rod of said jack is fixed a gripping device having an inverted T-shaped shoulder 72, which can be located in corresponding openings of the gripping heads of module 18 and frame 74. The aforementioned back-plate 90 is fixed parallel to supporting plate 100. A circular opening made in the same plate permits the passage of the rod of jack 102.

In the right-hand part of the drawing and below travelling crane 2 is shown a trolley 11 which moves horizontally on rails 108. Trolley 11 carries a tank 13. Below tank 13 there is module 18. The drawing also shows the geared motor 110 which drives member 19.

FIG. 5 is a sectional view of zone A for introducing the modules into the enclosure. It comprises from top to bottom an introduction cell A′, a module lifting cell A″ separated from cell A′ by a concrete floor and a cell A‴ containing the cell plug raising mechanism.

Module 18 enclosed within a tight container 112 provided with a cover 115, whilst the latter is positioned inside a casket 114, is brought in on a truck 116 horizontally movable on a rail track member 120 arranged transversely with respect to the longitudinal axis of the installation in introduction cell A′.

Cover 115 of container 112 has attachment means by means of which the plug 118 can be suspended. Vertical rails extending between the concrete floor of cell A″ and its ceiling or top make it possible to guide the cell plug during the raising thereof.

Rails 108 arranged over the entire length of the installation make it possible to displace trolley 11 of tank 13. Jacks 121 make it possible to attach cover 115 to the attachment device fixed in cell plug 118. These attachment devices are of a conventional type and will not be described in detail. Thus, cover 115 is attached to the cell plug 118, the assembly constituted by this plug, cover 115, tank 13 and module 18 can be raised by chains 122 to be brought into cell A″, as can be seen in the right-hand part of FIG. 5.

The tank trolley 11 is then brought beneath the said assembly and can then be descended until it rests on trolley 11. It is then disengaged from plug 118, trolley 11 is removed, so that plug 118 can be refitted. Thus, a module has been introduced into the enclosure.

The installation also comprises a zone C for removing the set down module. In an identical manner to introduction zone A removal zone C comprises, passing from bottom to top a removal zone C′ served by a rail track member oriented transversely with respect to the longitudinal axis of the assembly and on which travel the trolleys carrying caskets which are identical to casket 114 in FIG. 5, a cell C″ separated from cell C′ by a concrete floor in which there is an opening provided with a detachable plug, which can be moved vertically on vertical rails extending between the floor and ceiling of cell C″ and a cell C‴ containing the raising mechanism for the plug of cell C″.

The operations for removing a module from the enclosure take place in the reverse order to that described with reference to FIG. 5.

The aforementioned installation functions in the following manner. It will be assumed that hitherto functioning contaminated fluid circuit member proves to be defective. Firstly the installation is stopped, the defective module is dismantled and replaced by a satisfactory module. This operation takes place in two stages, frame 74 flanging module 18 to base 52 of the tight container is set down and it is then possible to remove module 18. In order to set down frame 74 shoulder 72 is introduced by horizontal translation of travelling crane 2 into the opening of frame 74. Jack 102 is pressurized. As head **78*a* of rod 78 projects above frame 74 the effect of pressurizing jack 102 is to engage frame 74 with back-plate 90. This leads to the descent of rod 78 and yoke 76 with respect to the frame and consequently compresses the elastic washers 80. It is then possible on lowering frame 74 to disengage the yokes 76 from the truncated cylindrical heads 66. The horizontal translation of travelling crane 2 brings the heads 66 into a position facing the openings of yoke 76. A vertical movement of travelling crane 2 permits the complete disengagement thereof. By means of crane 2 frame 74 is then set down at a not shown storage location after removing the pressure from jack 102**.

It is now easy to remove defective module 18 from tight container 44 in which it is located. For this purpose travelling crane 2 is again brought perpendicular to the defective module 18. Shoulder 72 is introduced into the inverted T-shaped opening constituting the gripping head of module 18 by horizontal translation of crane 2. This module is then raised up to the position shown in the left-hand part of FIG. 4. Tank 106 and its trolley 104 are then brought below module 18, which is deposited by means of crane 2 in tank 106. This module is then transferred by means of trolley 104 into the defective module rinsing zone B4.

Travelling crane 2 is then positioned perpendicularly with respect to a satisfactory or new module. A certain number of new or satisfactory modules are permanently stored within enclosure 1 in the storage zone B2 provided for this purpose. The new module 18 is brought perpendicular with respect to the tight container 44 from which the defective module has been previously removed and is then lowered into the container by horizontal translation of frame 96. The spacers 70 of said module make it possible to centre the latter with respect to the tight container by means of the columns of the latter. At the point where it was previously set down frame 74 is taken up by means of travelling crane 2. Jack 102 is then pressurized, which has the effect of engaging frame 74 against the back-plate 90 and of compressing elastic washers 80. It is then possible to introduce the truncated cylindrical heads 60 into yoke 76 by passing it through the cylindrical opening and then by horizontal translation of the travelling crane collar 66 can be brought into the narrower part. The jack is then depressurized in such a way that the elastic washers 80 can develop a high load which again engages module 18 with the base 52 of the tight container. Shoulder 72 is then removed from the gripping head of frame 74, after which the travelling crane is removed.

The pump of the satisfactory module 18 which has just been fitted is coupled to its drive and the installation is now ready to start up again.

The defective module 18 left on the tank trolley 11 is introduced by means of travelling crane 2 into rinsing station 6. The latter is constituted by a tight container, whose actual container 46 has larger lateral dimensions than those of the tight containers containing the operating modules. Apart from this rinsing station 6 is in all points identical to tight container 44. In particular it is provided with columns 62 making it possible to centre the defective module 18 relative to the latter. In addition, a frame 74' identical to frame 74 makes it possible to clamp the defective module 18 to base 52' of the rinsing station. This operation is carried out in the same way as described in connection with the clamping of the satisfactory module 18.

When the defective module 18 is secured in rinsing station 6 the pipes of its pump 19 are connected to a rinsing circuit, so that it can be internally rinsed at the same time as it is externally rinsed by means of nozzles.

The tank 13 must also be rinsed. Rinsing station 8 of tank 13 has a design which is of a conventional nature in the field of decontamination installations. Its internal arrangement is of no particular interest for the present invention, for which reason it is shown diagrammatically in FIG. 1.

After rinsing defective module 18 and tank 13, the rinsed module is placed in tank 13 on its trolley 11 by means of travelling crane 2.

The unused module is removed from the enclosure in exactly the same way, but in reverse order to the introduction thereof which has been described hereinbefore. The container of extraction casket 122 is raised, the cover of extraction casket 122 is attached to plug 124 and the cover is removed by travelling crane 2. The tank trolley 11 carrying the rinsed defective module 18 is then brought below the plug. The assembly constituted by plug 124, the cover, tank 13 and module 18 is then raised slightly by travelling crane 2, so as to disengage the tank trolley 11 which is then removed.

The assembly constituted by tank 13 and module 18, suspended on the cover of the container, which is itself attached to extraction cell plug 124, is lowered into the container of extraction casket 122. The cover is then detached from extraction cell plug 124, the container is lowered into extraction casket 122 and the cover is fitted to the latter, whilst extraction cell plug 124 is also refitted. The casket is then removed to a module repair workshop and a new or satisfactory module is introduced from the upstream end into zone B2 in accordance with a process which is the opposite to that of the process of removing the defective modules.

The above description refers to a special case where the replaced member is a pump, which has proved to be defective and which has been substituted by an identical, but satisfactory pump.

However, and as has been stated hereinbefore, this particular embodiment of the invention is in no way limitive and all the devices described, as well as the succession of operations can be equally well applied to the replacement of other members, such as valves, filters, etc. either by an identical or a different member. It is merely necessary for all the members to be fitted in identical tight containers, particularly with regards to the diameter and location of the connecting pipes and the drive or control shaft and that they are equipped with similarly positioned, identical gripping devices to ensure that their "standard" interchangeability is ensured within the scope of the present invention. Thus, a pump can be replaced by another pump of a different type, provided that the tight containers have the same dimensions, that the connecting pipes and drive shaft have the same diameters and locations and that the gripping devices are identical and are also identically positioned. It is always possible to fulfil the conditions by respectively choosing as the "standard" diameter of the pipes and shafts the largest diameters existing on the different pumps which can be used in the installation. The pipes will be brought to the same connecting locations on the base of the tight container by intermediate pipes adapted to each pump type and the drive shaft will be brought to the same location by horizontally and vertically displacing the pump.

In this way it is even possible to replace a pump by another member such as a valve if it proves necessary to modify the installation.

Moreover, in the succession of operations described hereinbefore, the actual operations of replacing the member to be changed are those described relative to FIGS. 1 to 5 and can be completed in approximately one hour, which is much less than the time required for carrying out the same work with the prior art processes.

Thus, the objects of the invention are certainly achieved.

We claim:

1. Installation for replacing a member in a contaminated fluid circuit, characterized in that it comprises a tight container (44) having internally a base (52) and supports (54) for said base supported on a framework (56); a module (18) which can be introduced into the tight container, said module comprising a horizontal base (20), a member (19) to be replaced fixed to said base, a ceiling (42) which is tightly fitted to the walls of the container, and a gripping head (40) making it possible to lift the module by means of a travelling crane (2); means centering the module relative to the tight container comprising vertical columns (58) integral with the base (52) of the container, and tubular spacers (70) integral with the module, each column comprising a lower centering part (60), an intermediate part (62) of smaller diameter, an upper centering part (64) and a truncated cylindrical head (66) connected to the upper centering part (64) by a smaller diameter collar (68); means tightly connecting the member (19) to the contaminated fluid circuit when the module is placed in said container (44) comprising vertical ducts (32) traversing the far end (48) and base (52) of the tight container, said ducts having ends facing feed (22) and discharge (24) pipes of the member (19), joints (36) placed between the ducts and the feed and discharge pipes, and means flanging or clamping themodule to the tight container so as to tighly seal the joints; and means driving the member (19).

2. Installation according to claim 1, characterized in that the means flanging or clamping the module to the tight container are comprised by: a frame (74) having in its upper part a gripping head (88) identical to that of the module on which are mounted lateral yokes (76) integral with vertical spindles (78), whose number is the same as that of the columns, said yokes (76) being arranged so as to face the latter, the vertical spindles sliding in the frame (74) and being moved upwards by a stack of elastic washers (80), the end thereof (78*a*) projecting above the frame (74), said yokes (76) having oblong holes, whereof one end permits the passage of the truncated cylindrical heads (66) of the columns (58), whilst the other narrower end only permits the passage of collars (68).

3. Device according to claim 2, characterized in that the gripping heads of the module and of the frame (40, 88) have an inverted T-shaped opening.

4. Installation according to claim 2, wherein a plurality of members (19) each forming part of a module (18) placed in a tight container (44) are enclosed in a tight enclosure (1) comprising means introducing the modules in a good state into the enclosure (1); the travelling crane (2) being able to move over the entire length of the enclosure (1) and permitting the vertical and horizontal handling of the module (18) and frame (74), a rinsing or washing station (6) for used modules; a tank (106) on which can be placed modules located on a trolley and able to move along rails (108) installed over the entire length of the enclosure (1), means rinsing or washing the said tank, and means removing the unused modules from the enclosure (1).

5. Installation according to claim 4, characterized in that the used module rinsing station is constituted by a tight container, whose actual container has a larger diameter than that of the containers of tight containers (44) containing the operating modules (18), whereby once the used module has been introduced into the rinsing station (6) it is connected to a cleaning fluid circuit, whilst it is externally rinsed or washed by means of nozzles.

6. Installation according to claim 4, characterized in that it also comprises auxiliary zones more particularly constituted by a service zone permitting exceptional interventions and a machine room containing activation means for various devices forming part of the module and control means for all the devices forming part of the module.

7. Installation according to any one of the claims 2, 3, 4, 5 or 6; characterized in that the travelling crane (2) comprises a hydraulic device comprising a frame (96) which can move vertically relative to a frame (92) of the travelling crane, columns (98) on said vertically movable frame and carrying, at the end of said columns (98) a back-plate (100) to which is fixed a hydraulic jack (102), said jack having a piston rod carrying at its free lower end a gripping device (72) able to cooperate with the gripping heads of module (18) and frame (74), a back-plate (90) fixed via the columns to the vertically movable frame (96) so that it is located parallel to the back-plate (100) between the latter and the gripping device, said jack (102) being connected in such a way to a circuit supplying it with pressurized fluid that when said fluid is introduced into the jack cylinder the piston of the jack moves upwards.

8. Process for dismantling from a contaminated fluid circulation circuit a member such as a pump, filter, valve, etc. and to replace it by another member utilizing the installation according to claim 7, characterized in that the process comprises the following steps; the installation is stopped and the member (19) is uncoupled from the means driving the member; the gripping device (72) of the travelling crane (2) is engaged with the gripping head (88) of the frame (74) of the means flanging or clamping the associated module to the tight container, the jack (102) is pressurized and the flanging or clamping means is set down; with the travelling crane (2) the module (18) containing the member to be replaced is raised and using a trolley (104) a tank is placed beneath the module; with the travelling crane the module (18) containing the member to be replaced is deposited in the tank (106) and is transferred with the trolley to an area for rinsing or washing the modules; with the travelling crane (2) a satisfactory or new module (18) stored in an area for storing modules in a satisfactory or new state is raised; with the travelling crane (2) the module (18) in a satisfactory or new state is transferred into the tight container which contained the member to be replaced, using the travelling crane (2) the flanging means is engaged on the satisfactory or new module (18) and then the pressure is removed in the jack (102) in order to carry out flanging; and the new or satisfactory member (19) is then coupled to its means for driving it and the installation is started up again.

9. Process according to claim 8, characterized in that the module (18) to be rinsed is introduced into the rinsing station (6), a module is clamped to the inside of the station to be rinsed, the feed and discharge pipes of said member thus being connected to a cleaning fluid circuit, whilst externally rinsing the module.

* * * * *